US007118425B2

(12) United States Patent
Chen

(10) Patent No.: US 7,118,425 B2
(45) Date of Patent: Oct. 10, 2006

(54) SOCKET STRUCTURE AND METHOD FOR FORMING THE SAME

(75) Inventor: Chun-Chen Chen, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/759,835

(22) Filed: Jan. 16, 2004

(65) Prior Publication Data

US 2004/0147174 A1 Jul. 29, 2004

(30) Foreign Application Priority Data

Jan. 20, 2003 (TW) ..... 92101166 A

(51) Int. Cl.
*H01R 13/405* (2006.01)

(52) U.S. Cl. ..... 439/736; 439/741; 439/79

(58) Field of Classification Search ..... 439/736, 439/741, 79, 870
See application file for complete search history.

(56) References Cited

U.S. PATENT DOCUMENTS 2,097,257 A * 10/1937 Schank ..... 439/173
2,296,346 A * 9/1942 Hearn ..... 439/741
3,091,656 A * 5/1963 Lamoureaux, Jr. ..... 174/52.3
3,189,672 A * 6/1965 Lyman, Jr. ..... 264/249
3,210,720 A * 10/1965 Harris, Jr. ..... 439/518
3,260,905 A * 7/1966 Rigazio ..... 361/308.3
3,766,442 A * 10/1973 Pearce et al. ..... 361/520
4,364,172 A * 12/1982 Kelly ..... 29/858
4,572,605 A * 2/1986 Hess ..... 439/585
5,655,931 A * 8/1997 Perugini ..... 439/573
6,049,039 A * 4/2000 Fushimi ..... 174/68.1

* cited by examiner

*Primary Examiner*—Briggitte Hammond
*Assistant Examiner*—X. Chung-Trans
(74) *Attorney, Agent, or Firm*—Volpe & Koenig, P.C.

(57) ABSTRACT

A socket and a method for forming the same are provided. The socket includes a main body, at least a terminal mounted on the main body, wherein the terminal includes a central pillar having a first end and a second end, a first ring mounted on the central pillar and having a first surface and a second surface, and a second ring mounted on the central pillar and having a third surface and a fourth surface, wherein the second surface and the third surface are adjacent to each other and have a distance therebetween, and at least a conducting piece having an opening mounted thereon for being sleeved on the second end of the central pillar and directly and electrically connected with the second ring.

16 Claims, 7 Drawing Sheets

SOCKET STRUCTURE AND METHOD FOR FORMING THE SAME

FIELD OF THE INVENTION

This invention relates to a socket and a method for forming the same, and more particular to a socket which has a better conductivity and safety and a method for forming the same.

BACKGROUND OF THE INVENTION

Please refer to FIG. 1 which illustrates a three-dimensional view of a socket structure in the prior arts, and FIGS. 2A~2B which illustrate a front view and a back view of the socket structure in the prior arts. As shown in these figures a socket 1 includes a plastic main body 10 having an indentation 11 and two terminals 12 mounted in the indentation 11, wherein the two terminals 12 are employed to be connected with a corresponding plug (not shown), and furthermore, the two terminals 12 are respectively and directly contacted with a conducting piece 13, as shown in FIG. 2B.

Please refer to FIG. 3 which illustrates a structural view of a terminal of a conventional socket. As shown in FIG. 3, in the conventional socket, a terminal 12 includes a central pillar 121 having a first end 1211 and a second end 1212, and an outer ring 122. As to the inner structural of the conventional socket, please refer to FIG. 4 which shows the A–A' sectional view of the socket shown in FIG. 2A. As shown in FIG. 4, the terminal 12 and the plastic main body 10 are assembled together through riveting the second end 1212 of the terminal 12.

The steps for assembling of the socket are as followed. Firstly, the two terminals 12 including the outer ring 122 are respectively assembled into the indentation 11 of the plastic main body 10, wherein the plastic main body 10 further includes two troughs in the indentation 11, and each of the two troughs has a shape identical to the shape of the outer ring 122 and the second end 1212 of the terminal 12. Then, when the two terminals 12 are respectively assembled into the troughs 11 of the plastic main body 10, the outer ring 122 of the terminal 12 will exactly reject against the plastic main body 10 and the second end 1212 of the terminal 12 will protrude out of the plastic main body 10. At this time, the conducting piece 13 is sleeved on the second end 1212 so as to contact the surface of the plastic main body, and then, the second end 1212 is riveted by an external force so as to fixedly reject the conducting piece 13 on the main body 10, as shown in FIG. 4. Simultaneously, the conducting piece 13 therefore forms a circular contact 40 with the terminal 12 for being a path for an electrical conduction.

However, it is obvious that the contact area of the circular contact 40 in the conventional socket structure is limited so that the electrical connection is therefore limited, too. Furthermore, in this conventional socket structural, because the terminal 12 is fixed through a cooperation of the outer ring 122, parts of the main body 41, the conducting piece 13 and the riveted second end 1212, when the socket is connected to a plug for power supply, parts of the plastic main body located between the outer ring 122 and the conducting piece 13 are always melted and deformed owing to the heat produced during electrical conduction, as shown by the label 50 in FIG. 5. Moreover, since the melted and deformed parts of the plastic main body can not be recovered when the temperature is lowered down, the above described originally stable and tight cooperation among all the elements will be destroyed so that the terminal might become movable, namely, the cooperation for fixing the terminal is "loosed".

In addition, because the terminal 12 is loosed, the assembling and separation between the socket and the plug will become a difficult job and the contact between the terminal 12 and the conducting piece 13 will also become a loosed contact which can not always keep in contact so as to cause an unstable power supply. Particularly, in this conventional socket structure, the contact between the conducting piece 13 and the terminal 12 is only achieved by the circular contact 40 and the riveted second end 1212, and thus, it is easy to cause a shake of the conducting piece 13 as long as the plastic main body 10 is melted. Therefore, the contact therebetween will be further reduced thereby. Hence, it is obvious that for the user, this unstable socket structure is an inconvenience. Besides, if the socket is employed to connect with an electrical equipment which needs a stable voltage for perfect operation, in fact, this unstable electrical contact might further damage the electrical equipment.

Consequently, the conventional socket structure described above not only might own a loosed terminal as the time goes by but also cause an unstable power supply, and thus, it is urgent to be improved either in structure or in function.

Because of the technical defects described above, the applicant keeps on carving unflaggingly to develop a "socket structure and method for forming the same" through wholehearted experience and research.

SUMMARY OF THE INVENTION

In accordance with an aspect of the present invention, a socket includes a main body, at least a terminal mounted on the main body, wherein the terminal includes a central pillar having a first end and a second end, a first ring mounted on the central pillar and having a first surface and a second surface, and a second ring mounted on the central pillar and having a third surface and a fourth surface, wherein the second surface and the third surface are adjacent to each other and have a distance therebetween, and at least a conducting piece having an opening mounted thereon for being sleeved on the second end of the central pillar and directly and electrically connected with the second ring.

Preferably, the main body has an indentation for positioning the at least a terminal.

Preferably, the main body is made of an insulated material.

Preferably, the main body is molded by injection.

Preferably, the first ring and the second ring have an identical diameter and the distance between the second surface and the third surface is larger than zero.

Preferably, a space between the first ring and the second ring of the terminal is tightly filled by the main body, and the first and the second rings are surrounded by the main body.

Preferably, the first ring and the second ring have an identical diameter and the distance between the second surface and the third surface is equal to zero.

Preferably, the distance between the second surface and the third surface is equal to zero.

Preferably, the second ring has a relatively smaller diameter than that of the first ring.

Preferably, the main body and the terminal are combined together through assembling.

Preferably, the first end of the terminal is assembled with a corresponding plug so as to electrically connect the socket with the plug.

Preferably, the central pillar, the first ring and the second ring of the terminal are integrally formed.

Preferably, the terminal and the conducting piece are made of a conductive material.

Preferably, the conducting piece is directly rejected against the second ring.

Preferably, the second end of the terminal is riveted so that the conducting piece is fixedly rejected against the second ring.

Preferably, the conducting-piece is directly and tightly pressed close to the second ring.

In accordance with another aspect of the present invention, a method for forming a socket having a main body, a conducting piece having an opening mounted thereon, and at least a terminal comprising a central pillar having a first end and a second end, a first ring mounted on the central pillar and having a first surface and a second surface, and a second ring mounted on the central pillar and having a third surface and a fourth surface, wherein the second surface and the third surface are adjacent to each other and have a distance therebetween includes steps of providing the at lest a terminal, injection molding the main body for surrounding the first ring and the second ring and filling the distance between the second surface and the third surface, sleeving the conducting piece on the second end of the terminal through the opening so as to contact the conducting piece with the fourth surface of the second ring, riveting the second end of the terminal for tightly rejecting or biasing the conducting piece against the second ring to be assembled thereby.

In accordance with another further aspect of the present invention, a method for forming a socket having a main body, a conducting piece having an opening mounted thereon, and at least a terminal comprising a central pillar having a first end and a second end, a first ring mounted on the central pillar and having a first surface and a second surface, and a second ring mounted on the central pillar and having a third surface and a fourth surface, wherein the second surface and the third surface are adjacent and pressed close to each other includes steps of forming an indentation on the main body for exactly positioning therein the first ring and the second ring, assembling the terminal into the indentation of the main body, sleeving the conducting piece on the second end of the terminal through the opening so as to contact the conducting piece with the second ring, and riveting the second end of the terminal for tightly rejecting or biasing the conducting piece against the second ring.

In accordance with an additional aspect of the present invention, a method for forming a socket comprising at least a terminal having a central pillar having a first end and a second end, and a first ring, a main body and a conducting piece having an opening mounted thereon includes sleeving the conducting piece on the second end of the terminal through the opening so as to contact the conducting piece with the first ring, riveting the second end of the terminal for tightly rejecting or biasing the conducting piece against the first ring and assembling thereof, and injection molding the main body for surrounding the first ring of the terminal and the conducting piece.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

It is an object of the present invention to provide a socket structure whose fixity among all elements will not be easily loosed for extending the usage life thereof and a method for forming the same.

It is another object of the present invention to provide a socket structure which can increase the contact area between a terminal and a conducting piece for maintaining a stable power supply.

It is another further object of the present invention to provide a socket structure which can reduce a melt phenomenon of a plastic main body due to the heat produced during operation so as to maintain a stable socket structure.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 6:
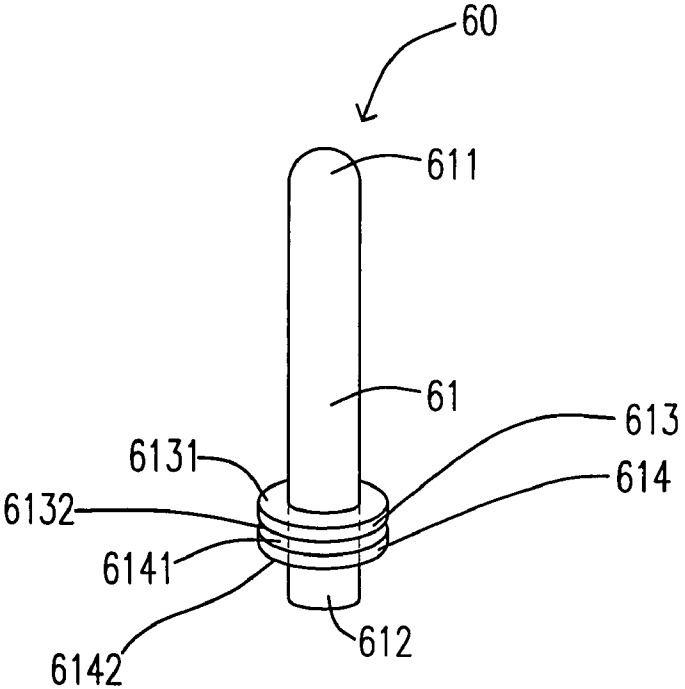
FIG. 6 is a three-dimensional view showing a terminal in a preferred embodiment according to the present invention.

Please refer to FIG. 6 which illustrates a three dimensional view of a terminal in a preferred embodiment according to the present invention. For solving the problems occurred in the prior arts, the present invention provides a novel terminal structure. As shown in FIG. 6, a terminal 60 includes a central pillar 61, a first ring 613, and a second ring 614, wherein the central pillar 61 further includes a first end 611 and a second end 612, and the first ring 613 has a first surface 6131 and a second surface 6132 and the second ring 614 has a third surface 6141 and a fourth surface 6142.

Figure 7:
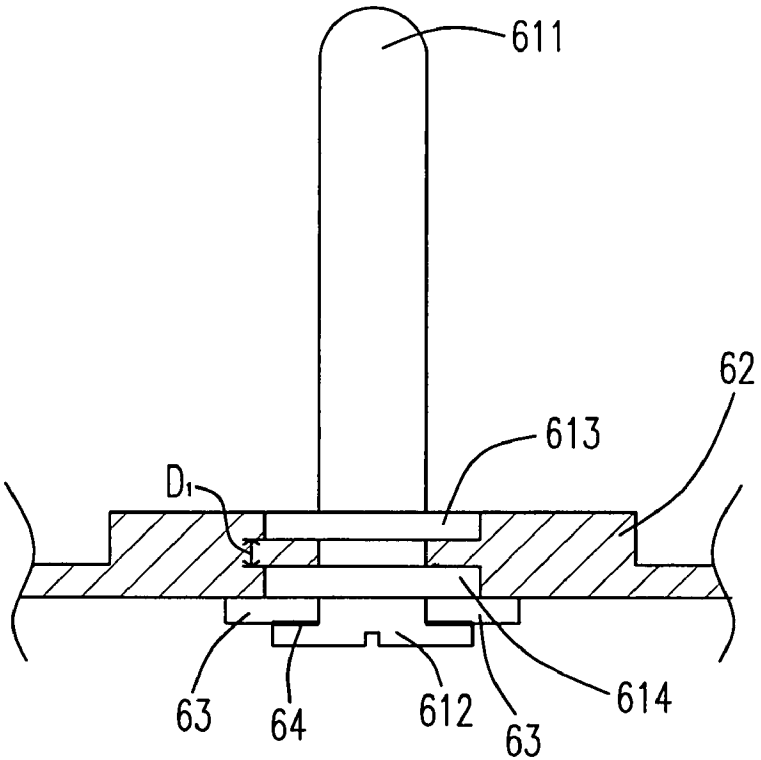
FIG. 7 is a sectional view showing a socket structure including the terminal in FIG. 6 in a preferred embodiment according to the present invention.

Now, please refer FIG. 7 which illustrates a sectional view of a socket structure including the terminal in FIG. 6. As shown in FIG. 7, the socket structure includes an insulated main body 62, the terminal 60 and a conducting piece 63. In this preferred embodiment, the terminal 60 including the first ring 613 and the second ring 614 as shown in FIG. 6 is firstly formed, wherein the central pillar 61, the first ring 613 and the second ring 614 are integrally formed and a distance ($D_1$) between the second surface 6132 of the first ring 613 and the third surface 6141 of the second ring 614 is larger than zero. Then, the insulated main body 62 is injection molded to surround the first ring 613 and the second ring 614 and fill the space between the two rings so that the terminal 60 is therefore mounted on the insulated main body 62. Finally, the conducting piece 63 is sleeved on the second end 612 of the central pillar 61 and contacted with the fourth surface 6142 of the second ring 614, and then, the second end 612 is riveted by an external force so that the conducting piece 63 can be fixedly and tightly rejected against the second ring 614.

In this structure described above, a contact plane 64 is increased, as compared with the prior arts, to be a further contact area between the terminal 60 and the conducting piece 63, in addition to the circular contact and the riveted second end as described in the conventional socket structure. Therefore, under this condition, there are three contact areas between the conducting piece 63 and the terminal 60, and thus even if the conducting piece 63 is loosed, the conducting piece 63 still will be contacted with the terminal unless the conducting piece 63 is completely departed from the terminal 60. Therefore, through the improved socket structure according to the present invention, a contact plane between the conducting piece and the terminal is increased so that the unstable power supply can be significantly reduced and the conduction stability of the socket also can be increased.

Figure 1:
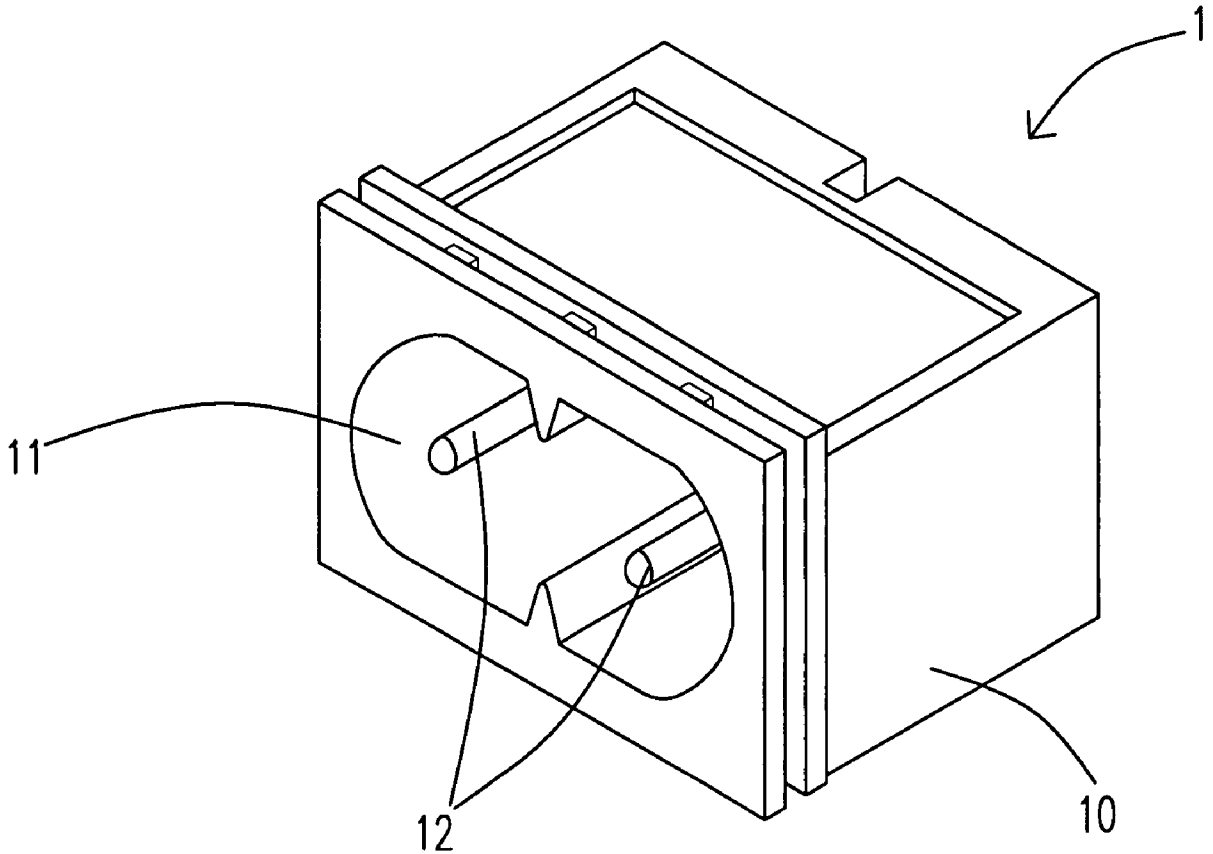
Fig. 1 (PRIOR ART)
FIG. 1 is a three-dimensional view showing a socket structure in the prior arts.
Figure 2B:
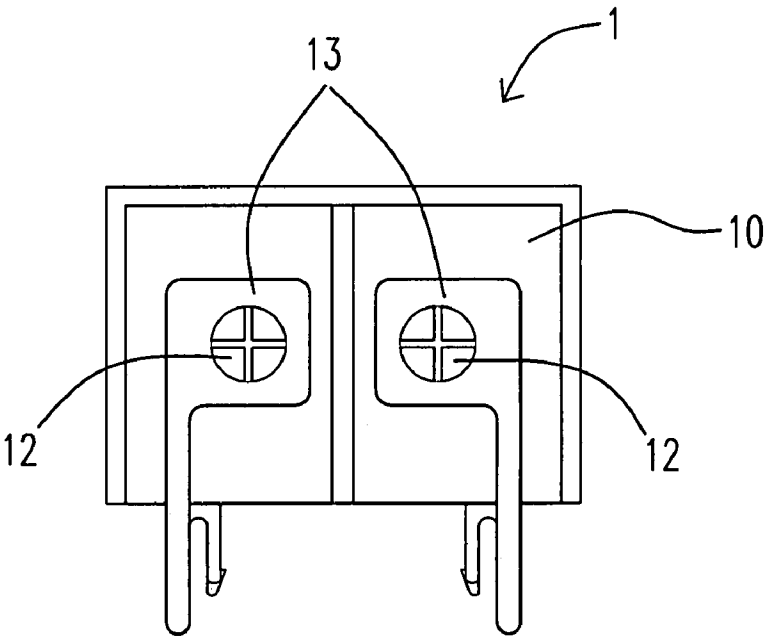
Fig. 2B(PRIOR ART)
FIG. 2B is a back view showing the socket structure in FIG. 1.
Figure 2A:
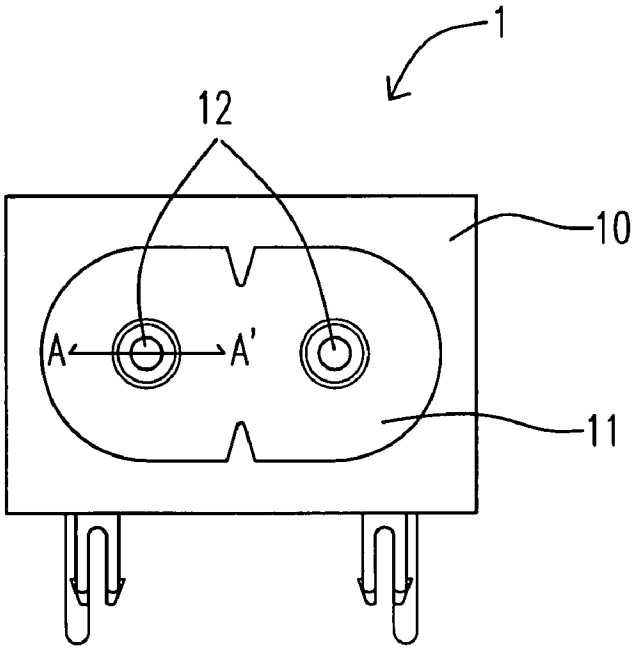
Fig. 2A(PRIOR ART)
FIG. 2A is a front view showing the socket structure in FIG. 1.
Figure 4:
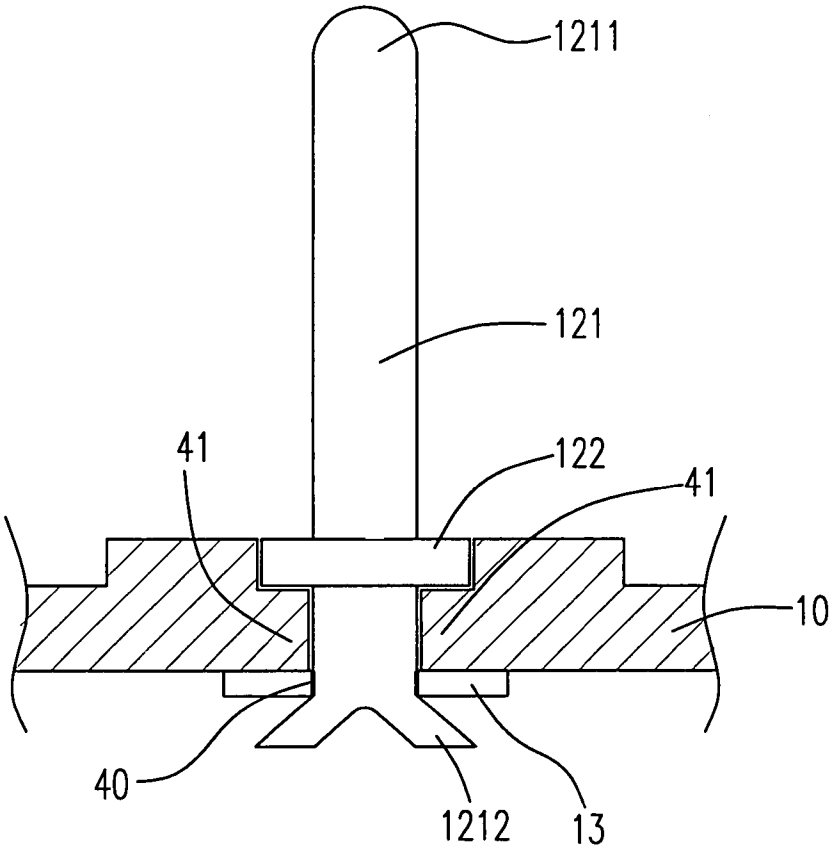
Fig. 4(PRIOR ART)
FIG. 4 is a A–A' sectional view showing the conventional socket structure in FIG. 2A.
Figure 3:
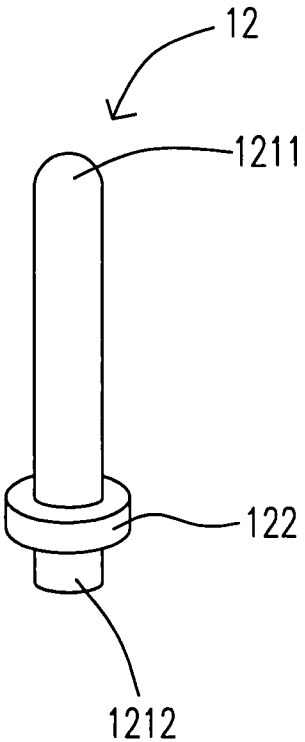
Fig. 3(PRIOR ART)
FIG. 3 is a structural schematic view showing a terminal of the conventional socket structure.
Figure 5:
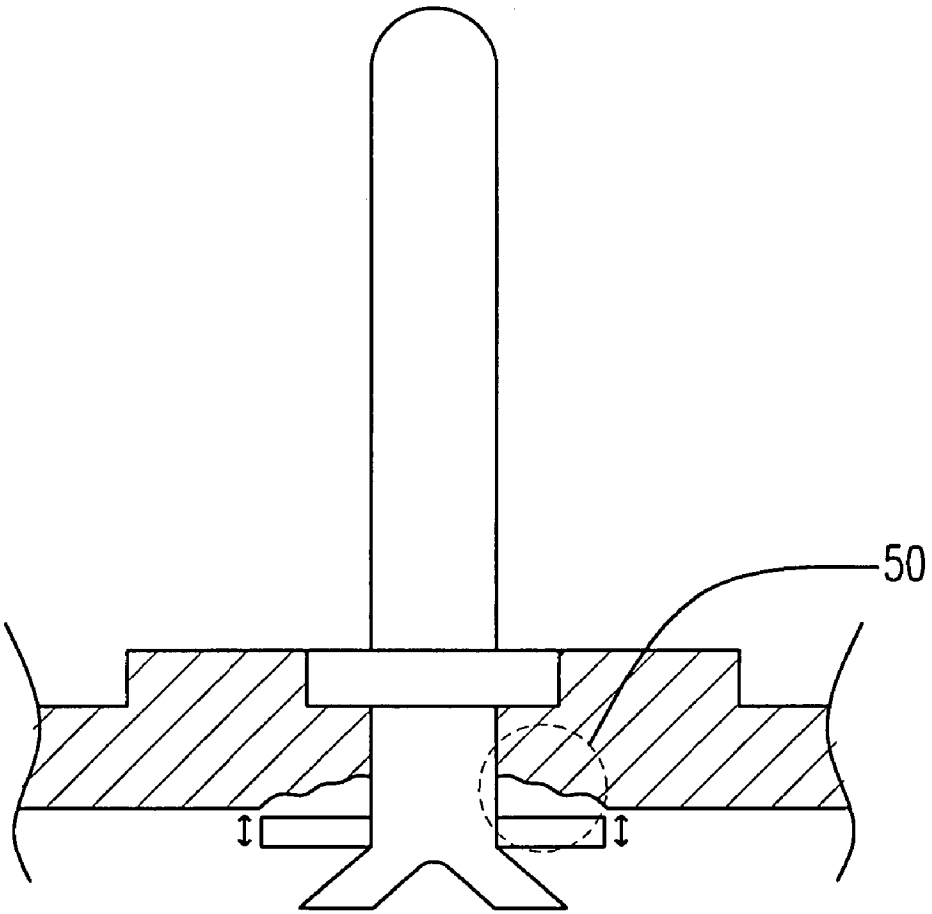
Fig. 5(PRIOR ART)
FIG. 5 is a sectional view showing a melt phenomenon of the conventional socket structure.

Moreover, in this preferred embodiment, as compared with the prior arts (FIG. 4), the contact manner among the terminal 60, the conducting piece 63 and the main body 62 is obviously safer because as shown in FIG. 6, the conducting piece 63 is rejected against the second ring 614, which is also made of a conducting material, and not the plastic main body, which will be melted due to the heat produced during operation, as mentioned in the prior arts. Therefore, the conducting piece will no longer be loosed due to the melt of the plastic main body and the fixity of the conducting piece can therefore be increased. Furthermore, even though the main body is melted, it will only occur at a position which does not influence the fixity of the conducting piece, for example, as shown in FIG. 7, the interface between parts of the, terminal which is ranged between the first ring and the second ring and the main body, or the interface between the conducting piece which do not contact with the second ring and the main body. At the same time, because the engagements in the socket according to present invention are obviously more than that in the prior arts, namely, the elements according to the present invention are more limited to each other, the loose caused by a melted main body can therefore be reduced, too.

Therefore, in this preferred embodiment, the terminal according to the present invention will not easily be loosed due to the melted main body, and even though the terminal is loosed due to the melted main body, the contact between the conducting piece and the terminal still can stay stable so as to prevent the current from being unstable. Consequently, this structure is really a breakthrough for the stability of power supply.

Figure 8:
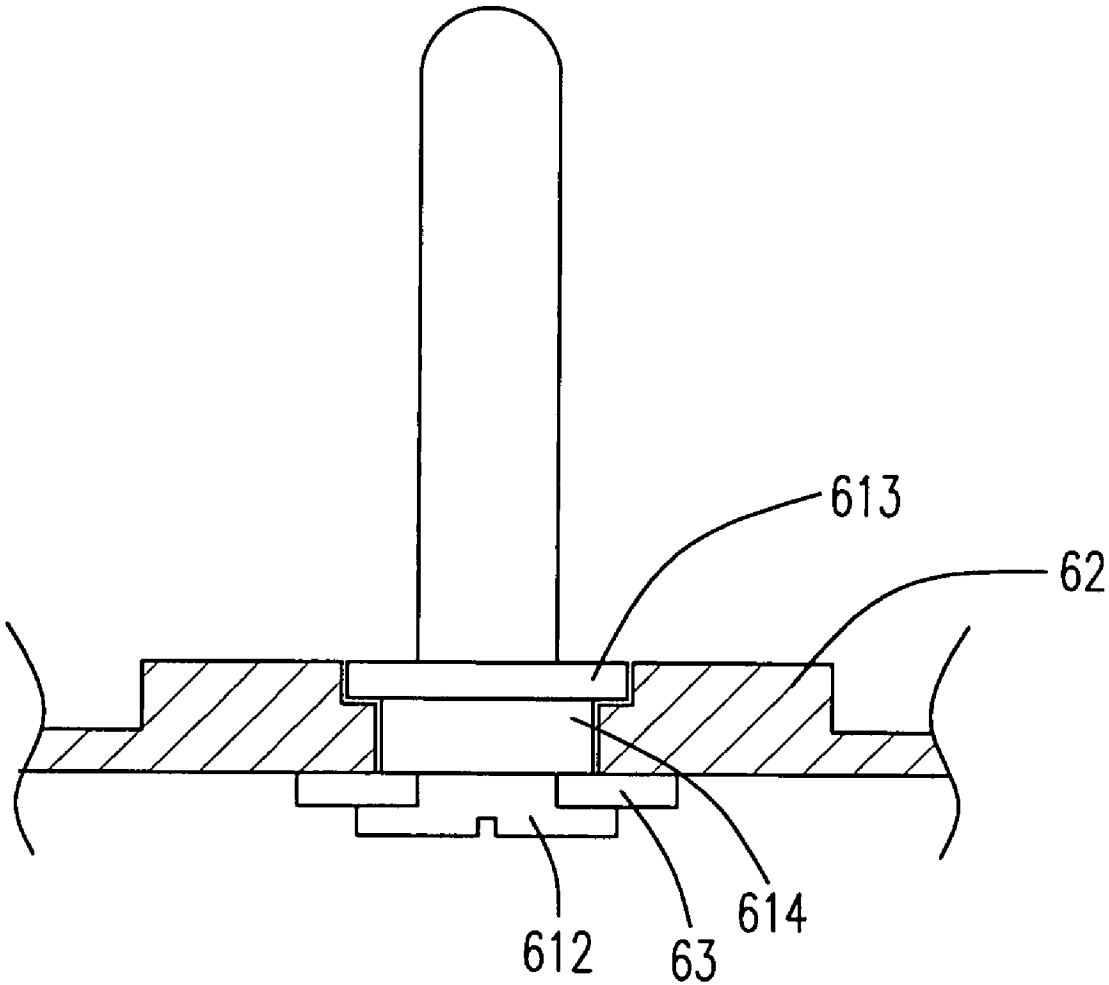
FIG. 8 is a sectional view showing a terminal in another preferred embodiment according to the present invention.

Moreover, please refer to FIG. 8 which illustrates a sectional view showing a socket structure in another preferred embodiment according to the present invention. As shown in FIG. 8, a socket identically includes a main body 62, a terminal 60 and a conducting piece 63 and the terminal 60 includes a first end 611, a second end 612, a first ring 613, and a second ring 614, wherein the first ring 613 has a first surface 6131 and a second surface 6132 and the second ring 614 has a third surface 6141 and a second surface 6142. Differently, in this preferred embodiment, the first ring 613 and the second ring 614 are stayed next to each other, that is to say, the second surface 6131 of the first ring 613 and the third surface 614 of the second ring 614 are pressed close to each other, and the diameter of the second ring 614 is slightly smaller than that of the first ring 613. As forming this structure, the terminal 60 including two rings 613 and 614 next to each other is firstly formed, preferably integrally formed, and then, the main body 62 is formed to match the shape of the terminal 60, namely, the main body 62 has a trough corresponding to the first ring 613 and the second ring 614. Sequentially, the main body 62 and the terminal 60 are assembled together and the second end 612 of the terminal 60 is sleeved by the conducting piece 63. Finally, through riveting the second end 612 of the terminal 60, the conducting piece 63 and the terminal 60 are fixed together.

In this preferred embodiment, the total contact areas between the conducting piece 63 and the terminal 60 are larger than that in the prior arts and the contact area between conducting piece 63 and the main body 62 is also reduced for avoiding the loosed terminal which is caused by the melted main body so that the defects described above also can be solved. Because it is believed that this preferred embodiment is an alternative choice for the socket structure according to the present invention, the terminal and the main body, in addition to injection molding the main body, also can be formed together through assembling.

Figure 9:
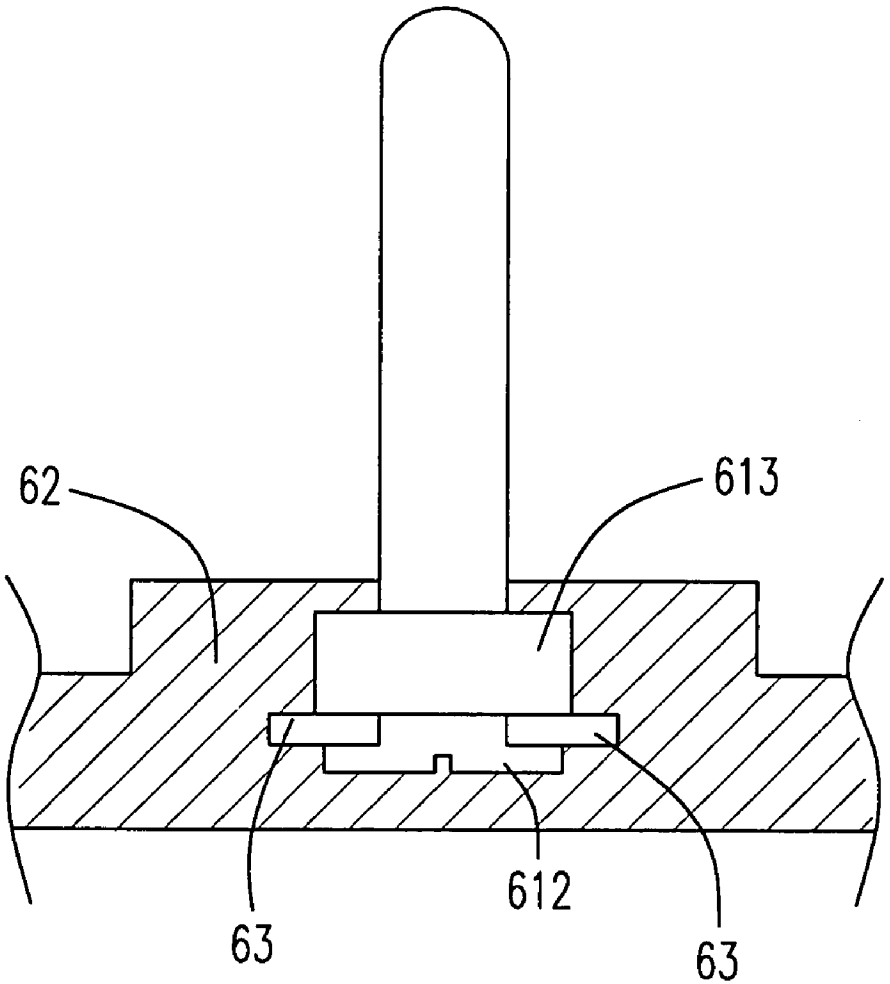
FIG. 9 is a sectional view showing a terminal in further another preferred embodiment according to the present invention.

Then, please refer to FIG. 9 which illustrates a sectional view showing a socket structure in another further preferred embodiment according to the present invention. As shown in FIG. 9, a socket includes a main body 62, a terminal 60 and a conducting piece 63, and the terminal 60 includes a first end 611, a second end 612 and a first ring 613. In this preferred embodiment, the method for forming the socket is a little different. Firstly, the terminal 60 with the first ring 613 is formed, the second end 612 of the terminal 60 is sleeved by the conducting piece 613, and then the second end 612 is riveted by an external force so as to fix the conducting piece 63 on the terminal 60. Then, the main body is injection molded to surround the first ring 613, the conducting piece 613 and the second end 612, as shown in FIG. 9.

It can be seen from FIG. 9 that the terminal 60 only has one ring 613 and not two rings. This is because the forming method in this preferred embodiment is to fix the conducting piece 63 on the terminal 60 first and then cover the first ring 613, the conducting piece 613 and the second end 612 through injection molding the main body. Therefore, the conducting piece 63 still can be directly rejected against the first ring 613 without assistance from the main body. That means when the diameters of the first ring and the second ring in FIG. 8 are identical, they can be simplified to be one single ring 613, as shown in FIG. 9, and still can achieve the purpose of the present invention. That is to say, the number of the contact areas between the conducting piece 63 and the terminal 60 still remain to be three and the electrical contact areas also can be increased, and therefore, even the main body is melted, portions of the terminal covered by the main body can also stay stable through the limitations thereamong. Hence, this preferred embodiment provides another choice for achieving the purpose of the present invention.

The socket structure and method for forming the same according to the present invention is achieved by modifying the terminal structure and the corresponding main body in the conventional socket. The socket structure according to the present invention employs two rings, which can be separated from each other or stayed close together, to increase the contact area between the conducting piece and the terminal so as to further reduce the possibility of losing the electrical contact therebetween and maintain the stability of power supply. Moreover, the socket structure according to the present invention can also avoid the conducting piece from being loosed due to the melted main body so that the safety of the socket can be increased, too. Furthermore, the structure of the socket according to the present invention also can be simplified and modified for conforming different manufacturing demands without increasing the manufacturing steps.

In view of the aforesaid, the socket structure and method for forming the same according to the present invention, as compared with the prior arts, is advantageous of increasing the contact areas between the conducting piece and the terminal, avoiding the unstable power supply from the melted main body which is caused by the heat produced during operation and increasing the usage safety of the socket. Furthermore, the method for forming the socket according to the present invention can have different choices for conforming to the demands without increasing the forming steps so that the cost will not be increased. Consequently, the present invention is really a creative invention and is extremely suitable for industrial production.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A socket comprising:

a main body;

at least a terminal mounted on said main body, said terminal comprising:

a central pillar having a first end and a second end;

a first ring mounted on said central pillar having a first surface and a second surface; and a second ring mounted on said central pillar having a third surface and a fourth surface, wherein said second surface and said third surface are adjacent to each other and have a distance therebetween; and at least a conducting piece having an opening for being sleeved on said second end of said central pillar and directly and electrically connected with said second ring, said central pillar through said opening, and said second end, after assembled, of said terminal to form thereby three contact areas thereamong tightly, by a purposely selected amount of an external force, wherein said second end of said terminal is riveted by said purposely selected amount of external force so that said conducting piece is directly and fixedly rejected against said second ring and said purposely selected amount of said external force is selected based, at least in part, on forming said contact area, which is a contact plane, between said riveted second end of said terminal and said conducting piece.

2. The socket according to claim 1, wherein said main body has an indentation for positioning said at least a terminal.

3. The socket according to claim 1, wherein said main body is made of an insulated material.

4. The socket according to claim 1, wherein said main body is molded by injection.

5. The socket according to claim 1, wherein said first ring and said second ring have an identical diameter and said distance between said second surface and said third surface is equal to zero.

6. The socket according to claim 1, wherein said first end of said terminal is assembled with a corresponding plug so as to electrically connect said socket with said plug.

7. The socket according to claim 1, wherein said central pillar, said first ring and said second ring of said terminal are integrally formed.

8. The socket according to claim 1, wherein said terminal and said conducting piece are made of a conductive material.

9. The socket according to claim 1, wherein said conducting piece is directly and tightly pressed close to said second ring.

10. The socket according to claim 1, wherein said second end of said terminal is assembled by said purposely selected amount of said external force so that said conducting piece is directly and fixedly rejected against said second ring and said purposely selected amount of said external force is selected based at least in part on forming said contact area, which is a contact plane, between said assembled second end of said terminal and said conducting piece.

11. The socket according to claim 1, wherein said first ring and said second ring have an identical diameter and said distance between said second surface and said third surface is larger than zero.

12. The socket according to claim 11, wherein a space between said first ring and said second ring of said terminal is tightly filled by said main body, and said first and said second rings are surrounded by said main body.

13. The socket according to claim 1, wherein said distance between said second surface and said third surface is equal to zero.

14. The socket according to claim 13, wherein said second ring has a relatively smaller diameter than that of said first ring.

15. The socket according to claim 13, wherein said main body and said terminal are combined together through assembling.

16. A socket comprising:

a main body;

at least a terminal mounted on said main body, said terminal comprising:

a central pillar having a first end and a second end;

a first ring mounted on said central pillar having a first surface and a second surface; and a second ring mounted on said central pillar having a third surface and a fourth surface, wherein said second surface and said third surface are adjacent to each other and have a distance therebetween; and at least a conducting piece having an opening for being sleeved on said second end of said central pillar and directly and electrically connected with said second ring, said central pillar through said opening, and said second end, after assembled, of said terminal to form thereby three contact areas thereamong tightly, by a purposely selected amount of an external force;

wherein said second end of said terminal is riveted by said purposely selected amount of external force so that said conducting piece is directly and fixedly biased against said second ring and said purposely selected amount of said external force is selected based, at least in part, on forming said three contact areas, at least one of which is a contact plane between said riveted second end of said terminal and said conducting piece.

* * * * *